United States Patent [19]

Fox, Jr.

[11] 3,950,911

[45] Apr. 20, 1976

[54] APPARATUS FOR REINFORCING CONCRETE

[76] Inventor: Carl B. Fox, Jr., 10 Hedwig Circle, Houston, Tex. 77024

[22] Filed: Sept. 16, 1974

[21] Appl. No.: 506,268

[52] U.S. Cl. ..... 52/664; 52/687; 404/134

[51] Int. Cl.[2] ..... E04C 2/42; E04C 5/04

[58] Field of Search ..... 52/664, 660, 452, 454, 52/581, 687, 688; 404/70, 134, 135, 136

[56] References Cited

UNITED STATES PATENTS

| | | | |
|---|---|---|---|
| 902,335 | 10/1908 | Sherwood | 52/581 |
| 1,561,323 | 11/1925 | Gregg | 52/687 |
| 1,578,075 | 3/1926 | Christopher | 52/454 |
| 1,872,984 | 8/1932 | Land | 52/452 |
| 3,683,581 | 8/1972 | Yamaso | 51/581 |

FOREIGN PATENTS OR APPLICATIONS

| | | | |
|---|---|---|---|
| 920,131 | 3/1963 | United Kingdom | 52/664 |
| 859,728 | 9/1940 | France | 52/664 |

*Primary Examiner*—Ernest R. Purser
*Assistant Examiner*—James L. Ridgill, Jr.

[57] ABSTRACT

Method and apparatus for reinforcing concrete, and like materials, wherein modular units or sections of reinforcing mesh are provided which are connectable to provide a larger reinforcing mesh. A variety of forms of connections between adjacent mesh sections may be used. The individual mesh sections and the interconnected mesh sections are self supporting, so that no support elements for the mesh are necessary. The mesh sections are preferably made small and light enough to be carried and assembled by a single person. The mesh sections are preferably of forms capable of being stacked or baled compactly, for ease of transportation and storage.

6 Claims, 9 Drawing Figures

APPARATUS FOR REINFORCING CONCRETE

BACKGROUND OF THE INVENTION

The bars, rods, and welded wire mesh customarily employed for reinforcing concrete are difficult to handle, store, transport, and use. Long reinforcing bars or rods must be transported on long trucks or trailers, which are often awkward to load and drive. Storage or reinforcing rods or bars out of the weather requires warehouses or other storage facilities of substantial dimensions because of the lengths of the rods or bars. The rods or bars must be individually placed in position in a reinforcing mesh and the intersections individually tied or otherwise affixed together before the reinforcing mesh is ready for use. Furthermore, the rods or bars must often be cut to length prior to use. Provision of reinforcing meshes for irregularly shaped areas is often difficult, requiring cutting and fitting of the bars or rods to adapt to the irregular dimensions and contours of the areas.

In the case of welded wire reinforcing mesh, the mesh is usually provided in roll form, and the mesh must be straightened or flattened before cutting to appropriate sizes for use. In the cases of both reinforcing bars and rods and welded wire mesh, supports must be provided to maintain the mesh a suitable distance from the ground or other surface while the concrete is poured so that the mesh may perform its reinforcing function satisfactorily. Mesh supporting accessories are available, but their use adds to the expense of the finished mesh. Oftentimes miscellaneous supports such as pieces of wood, stone, brick, concrete ingots, or the like are employed. In the case of all supports, it is difficult to keep the mesh down upon the supports in a flat condition, as the mesh if not perfectly flat tends to rise above at least some of the supports.

SUMMARY OF THE INVENTION

According to the invention, reinforcing mesh is provided in interlocking modular sections or units which may be joined together to fit substantially any area or surface over which reinforcing mesh must be provided. The individual sections may be of substantially any dimensions, of any selected widths and lengths, to adapt to a diversity of uses in fitting the mesh to specified areas and shapes. Different forms of interlocking arrangements between the sections may be provided. Sections may be joined to maintain all individual sections in interconnected condition, and adjacent sections may be in the same or different planes so that the reinforcing sections may be used on flat or curved surfaces. Provision may be made for attaching the reinforcing mesh to the ground or to horizontal, vertical, and angular surfaces.

The apparatus and methods of use afforded by the invention will result in substantial economies. The mesh sections may be readily laid and joined without tools and without use of supporting devices. The reinforcing mesh sections are simple to manufacture, and are adapted for compact orderly storage in limited areas. The mesh sections according to the invention may be readily moved and transported without special vehicles being required. The material from which the mesh sections are made may be of any size and weight and strength, so that the invention is adaptable to lightweight mesh as well as to medium and heavy weights of mesh. The mesh sections may be handled and laid in place for use by a single person without assistance from others being necessary. No tools or connecting devices or supporting devices for the mesh are required, except in the case where the mesh is to be rigidly secured in place. The mesh sections are adapted to be stacked compactly for shipment and storage.

Other objects and advantages of the invention will appear from the following detailed description of preferred embodiments of the method and apparatus, during which reference is made to the accompanying drawings.

BRIEF DESCRIPTIONS OF THE DRAWINGS

DESCRIPTIONS OF THE PREFERRED EMBODIMENTS

Figure 1:
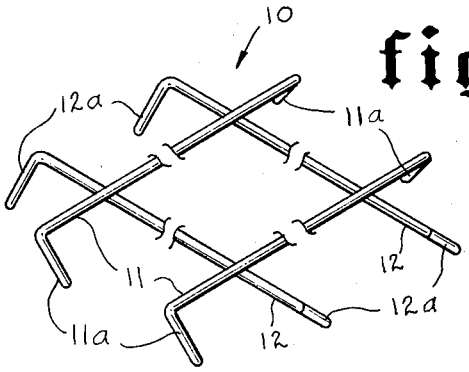
FIG. 1 is an upper perspective view of a single reinforcing mesh section according to the invention.

Referring now to the drawings in detail, and first to FIG. 1, there is shown an individual or single reinforcing mesh section 10. Mesh section 10 is made up of a plurality of spaced wires, rods, or bars 11 disposed parallelly in one direction and another plurality of spaced rods, bars, or wires 12 disposed perpendicular to elements 11. The intersections of the crossed elements are preferably connected together by welding, or the like, but other means of more or less permanent joinder may be utilized if found to be suitable. The wire, bar, or rod elements are indicated to be broken in the drawing, this showing indicating that the pluralities of elements 11, 12 may each be of any suitable larger number than two. In other words, the individual mesh sections may be longer and/or wider than the exact structure shown in the drawing, by increasing the pluralities of elements 11 and 12 as desired.

Figure 2:
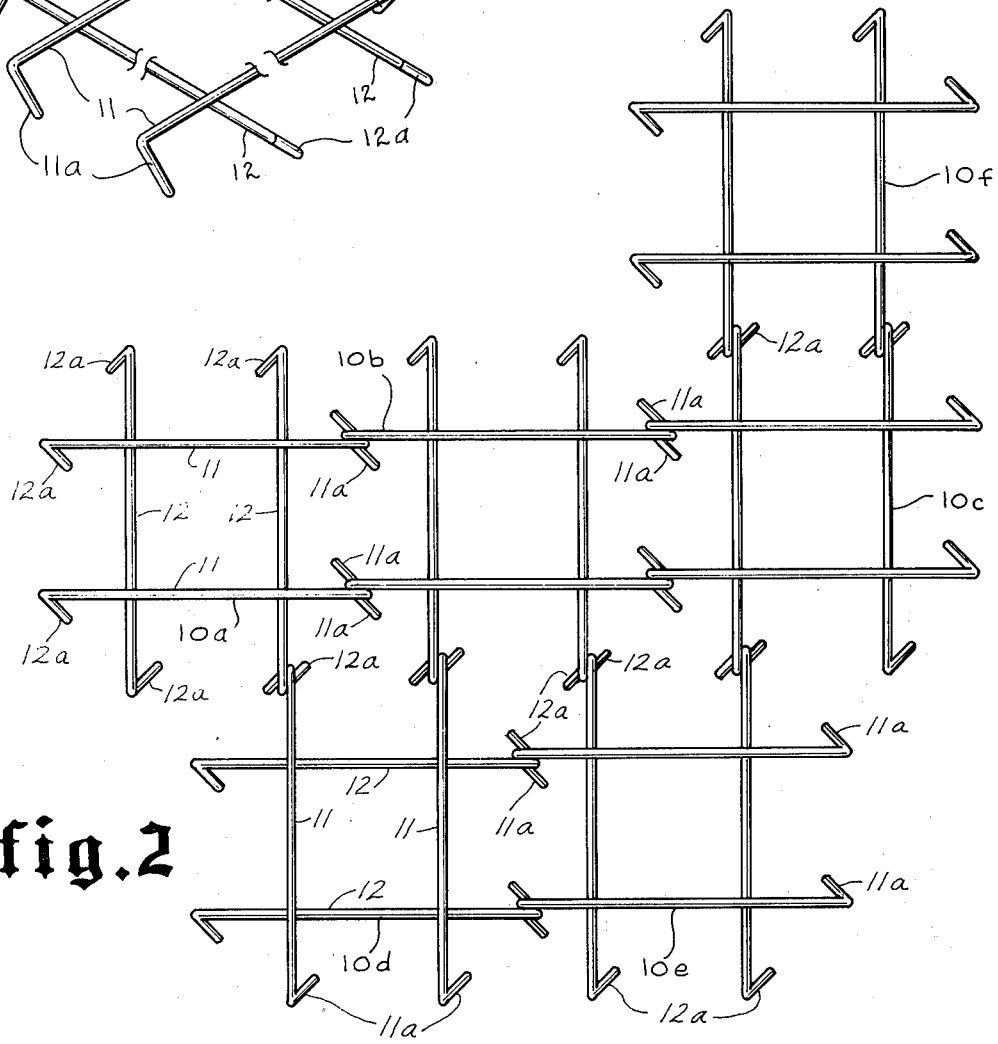
FIG. 2 is a top view of the apparatus showing a method for joining the individual reinforcing mesh sections together for use.

The ends of the elements 11, 12 are bent angularly downwardly and inwardly as shown, to form hooks. Referring now also to FIG. 2, the angularly bent ends 11*a* and the similarly angular bent ends 12*a* are hooked together to interconnect the individual mesh sections. In FIG. 2, six individual mesh sections 10, which are designated 10*a*–10*f*, are shown joined together in two manners. Mesh sections 10*a*, 10*b*, 10*c*, 10*f* are shown joined together so that the sections are in line, with the two side hooks of one section hooked with the two side hooks of another section. Mesh sections 10*d*, 10*e* are joined offset with respect to mesh sections 10*a*, 10*b*, 10*c*, the two side hooks of each of sections 10*d*, 10*e* being hooked with side hooks of different mesh sections. Elements 10*d*, 10*e* bridge the joinders of elements 10*a*–10*c*, and vice versa, which prevents any but intentional disconnections of these mesh section joinders.

Figure 3:
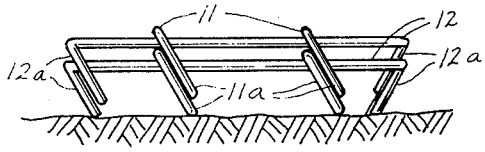
FIG. 3 is a side elevational view showing plural reinforcing mesh sections in stacked condition, and illustrating the means for support of the mesh above a surface.

Referring now to FIG. 3 of the drawings, two individual mesh sections 10 are shown stacked one above the other. Because of the angular downward dispositions of the joinder portions 11*a* and 12*a*, the mesh sections may be stacked compactly, without wasted space therebetween. The mesh sections may be stacked in such manner for transport and shipment and may be so disposed until use. Individual sections may be rotated 90° in a horizontal plane without disruption of the stacking. Stacks or bales of the mesh sections may be tied or otherwise fastened together to prevent separation of the stacks or bales.

Figure 4:
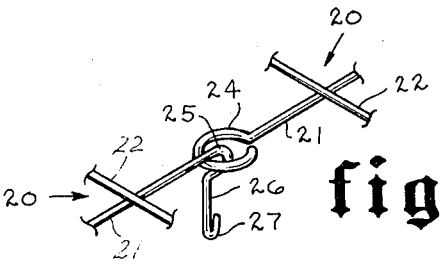
FIG. 4 is a partial upper perspective view showing a modified form of mesh section junction.

In FIG. 4, a modified form of joinder for use between adjacent mesh sections is shown. In this case, the mesh sections 20 have crossed elements 21, 22 suitably joined at their crossings. Instead of the downwardly angularly bent portions 11a, 12a, the elements 21 and 22 are each provided with a loop 24 at one end and a hook 25 at the other end. The hooks are downturned at their extremities as at 26 to provide a means for spacing the mesh above the ground or other surface. The hooks 25 are prevented from removal from the loops 24 because of the offset positioning of the downwardly extending portions 26. The loops and hooks are alternated at each side of each mesh section so that any side of any mesh section may be connected to any side of another mesh section.

Also shown in FIG. 4 is the terminal bend 27 at the lower end of elements 26 which may be also employed in the mesh sections 10 of FIGS. 1–3. The terminal bends 27 will prevent penetration of the sheets of plastic often employed beneath concrete slabs. It has become almost standard procedure to line the slab forms with plastic to seal beneath the completed slab and to prevent drainage from the forms. The provision of terminal bends 27 dulls and smooths the wire or bar or rod ends which prevents them from too readily penetrating the plastic sheeting.

Figure 5:
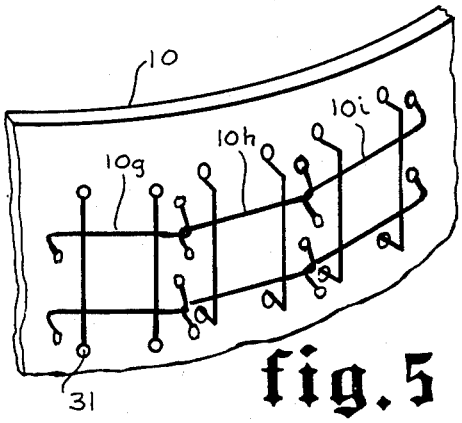
FIG. 5 is a perspective view indicating how the mesh sections may be attached to a surface and also indicating how the mesh sections may be disposed in curved relationships.

Referring now to FIG. 5 of the drawings, there is shown a modified manner of use of the individual reinforcing mesh sections 10. The sections 10 are further modified as will be described. As shown in FIG. 5, the individual mesh sections 10*g*–10*i* are disposed around a curved surface 30, which may be a wall of a form. The mesh sections are hooked together as before, except that the hook joinders here provide a means for bending of the connected mesh sections upon a curved surface. Therefore, by such use of the invention, reinforcing mesh may be readily and quickly provided on a contoured or curved surface of a form or of the ground without special provision of shaped or curved reinforcing mesh pieces. Also shown in FIG. 5 are the elements 21, 22 which have angularly downturned ends having transverse loop formations 31 at their ends. These loops are conveniently used to attach the mesh sections to a form or to the ground or to any other surface by inserting nails or screws or the like through the loops 31 to accomplish the attachment. As an example of the method, a curved concrete wall may be reinforced by mesh attached as shown to one side of the form, after which the opposite side of the form may be constructed in spaced relation to the mesh and equidistant from the opposite form wall.

Figure 6:
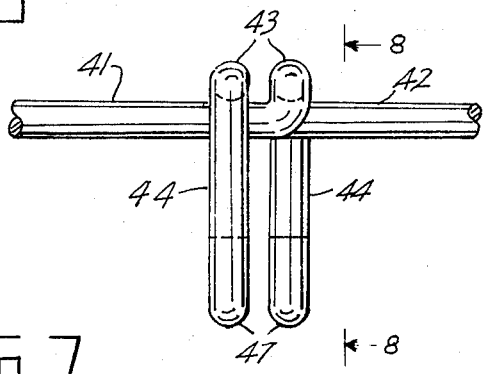
FIG. 6–7 are, respectively, partial side and top elevations showing a modified form of apparatus.
Figure 8:
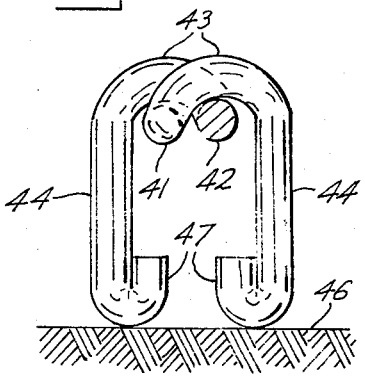
FIG. 8 is a vertical cross section taken at line 8—8 of FIG. 6.
Figure 7:
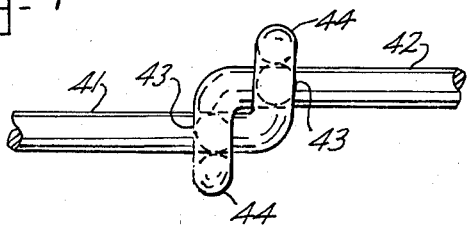

FIGS. 6–8 shown an end connection for the bars, rods or wires of the mesh sections which is easily and economically formed, and which is readily connected or disconnected. In FIGS. 6–8, the bars 41, 42 each have an upwardly arched transverse bend 43 from each of which the bar end portions 44 extend downwardly to the ground 46, or other surface upon which the mesh sections are supported. The bar ends are bent in tight U-bends at 47, to provide non-penetrating ends for the bars. The end portions 44 are of suitable lengths to support the mesh at a proper height. The bars 41, 42, of course, are each a single bar of a mesh section of crisscrossed bars of like construction to the bar sections of the other drawings. Each bar of each mesh section will have the end shape of bars 41, 42.

The bar ends are joined by hooking each arch 43 over the opposite bar adjacent its arch, as shown. It is necessary to move the mesh sections together angularly one to the other to accomplish this connection.

Other suitable forms of mesh element connections may be used, consistent with the principles of the invention.

Figure 9:
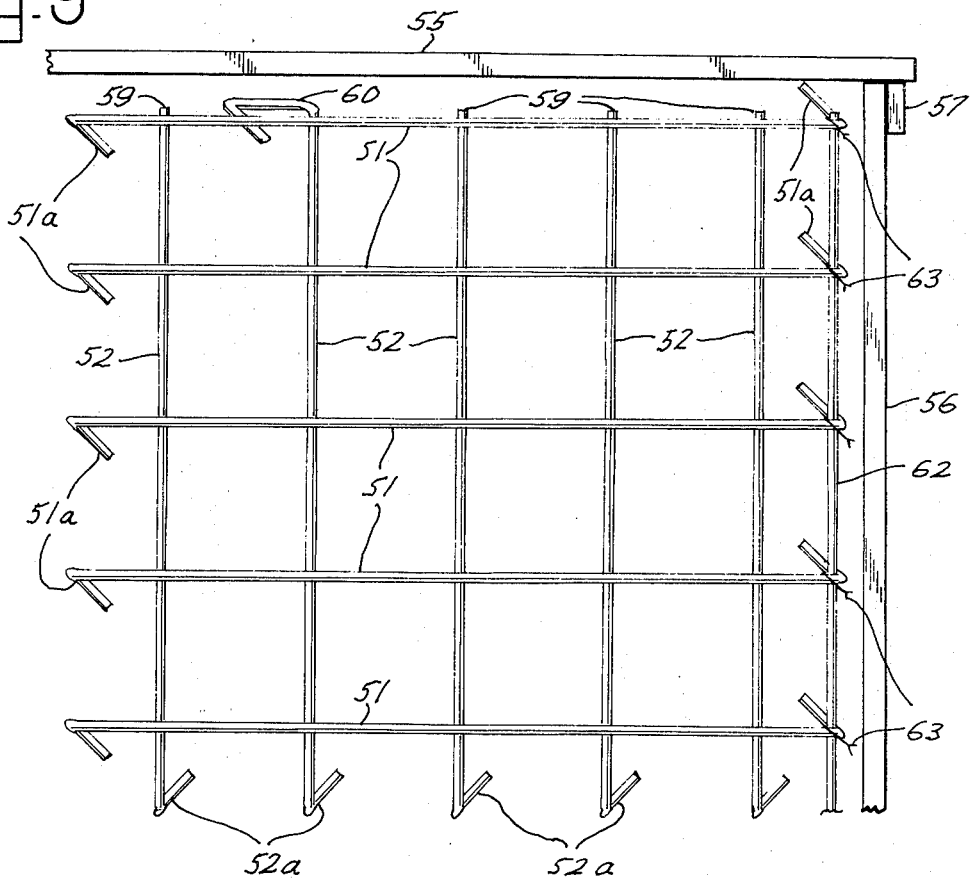
FIG. 9 is a plan view showing a modified form of apparatus, and illustrating two methods for use at the edges of a reinforcing mesh.

FIG. 9 shows three methods for providing mesh section edges which do not have protruding bars, rods or wires. The crisscrossed elements 51, 52, of which there are five of each shown, are suitably connected together in mesh form. The element ends are angularly downturned at 51*a*, 52*a*, as in the FIG. 1 embodiment, to provide for connection of the mesh element to other mesh elements.

Elements 55, 56 are form elements, supported by stake 57. Adjacent form element 55, four of the elements 52 are clipped off at 59. The fith element 52 is bent back at 60. Both of these procedures eliminate the projections of the element 52 ends adjacent form element 55. A bar or wire 62 is affixed by wires 63 within the hook angles at the righthand ends of the bars 51. This provides a terminal reinforcing element closely adjacent form element 56. It is not necessary that any of these procedures be used to provide a finished mesh edge at the overall mesh border, but any of them may be used if desired.

It will readily be understood that the invention provides a quick and convenient method and apparatus for the installation and use of reinforcing mesh. In providing reinforcement for a slab, such as a driveway, sidewalk, patio, floor, or the like, it is necessary only to lay a first reinforcing section upon the ground or other surface, and then to connect other similar or dis-similar reinforcing mesh sections thereto in the described manners to assemble the complete reinforcing mesh. The individual sections are laid one at a time as necessary to fill the form. As will be readily understood, a workman, working alone, may individually handle the individual mesh sections and lay them one by one to form the completed overall mesh. If it is desired that the outer edge or perimeter of the completed mesh have a rod or wire extending therealong, then it is possible to either wire a rod, bar, or wire within the outermost hooks around the edge or perimeter, or to clip off the extending ends of elements 11, 12 as appropriate adjacent to the crossed element near the edge, or to simply bend back the extending ends which are not connected to other reinforcing mesh sections, all three of which procedures are illustrated in FIG. 9. In this way, a terminal edge around the installed mesh may be made smooth without the unconnected projecting ends of the elements 11, 12. It should by now be understood that a single workman, or more if desired, may very quickly lay the mesh sections over an extensive area in a short period of time, thus not only eliminating the need for help in some cases, but also resulting in a very substantial savings in cost.

It should by now be understood that the angularly downturned end portions of the mesh sections provide adequate support for the mesh sections above the ground. No other provision of support for the mesh is normally required. The lengths of the downturned element ends may be made as suitable for supporting the mesh sections at a proper distance above the ground or other surface.

While preferred embodiments of the methods and apparatus have been shown and described, many modifications thereof may be made by a person skilled in the art without departing from the spirit of the invention, and it is intended to protect by Letters Patent all forms of the invention falling within the scope of the following claims.

I claim:

1. Reinforcing mesh apparatus comprising two crossed pluralities of spaced longitudinal elements welded together to form a mesh section, the ends of said longtudinal elements extending outward from edges of said mesh section and terminating in downturned end portions adapted to be hooked to identical downturned end portions of longitudinal elements of other said mesh sections without use of any other connection means, the ends of said downturned end portions terminating at a suitable distance transverse to said mesh section to support said mesh section at a suitable reinforcing distance from a surface against which concrete is to be poured.

2. Reinforcing mesh, comprising a plurality of interconnected mesh sections as described in claim 1.

3. The combination of claim 1, each said downturned end portion being in the form of a hook formed by bending the end of the longitudinal element to an acute angle with the remainder of the longitudinal element and angularly of a plane parallel to the longitudinal element and perpendicular to the mesh section.

4. The combination of claim 1, each said connection means being formed by bending the end of the longitudinal element in an upward arch laterally of the longitudinal element and downwardly past said arch to provide the described support for the mesh section.

5. The combination of claim 1, wherein said said downturned end portions which extend transversely of said mesh section are dulled by bending the ends thereof to avoid puncture of membranes covering the surface against which concrete is to be poured.

6. The combination of claim 1, wherein said downturned end portions which extend transversely of said mesh section terminate in loops through which fastening means may be inserted to connect the mesh section to a surface.

* * * * *